US005165780A

United States Patent [19]

Katz

[11] Patent Number: 5,165,780

[45] Date of Patent: Nov. 24, 1992

[54] BATH CABINET AND LIGHT FIXTURE MOUNTING AND FINISHING APPARATUS

[75] Inventor: Howard S. Katz, Riegelsville, Pa.

[73] Assignee: Robern, Inc., Bensalem, Pa.

[21] Appl. No.: 787,440

[22] Filed: Nov. 4, 1991

Related U.S. Application Data

[62] Division of Ser. No. 446,511, Dec. 5, 1989, Pat. No. 5,140,506.

[51] Int. Cl.[5] ..... F21V 21/02

[52] U.S. Cl. ..... 362/147; 362/135; 362/249

[58] Field of Search ..... 362/128, 133, 135, 136, 362/140, 147, 249, 362, 368; 312/223, 224, 225, 226, 227

[56] References Cited

U.S. PATENT DOCUMENTS

| | | | |
|---|---|---|---|
| 1,379,991 | 5/1921 | Knap . | |
| 1,930,244 | 10/1933 | Lewinsohn et al. | 240/4.1 |
| 1,941,126 | 12/1933 | Blackman | 312/112 |
| 1,957,847 | 5/1934 | Peters | 362/135 |
| 2,622,356 | 12/1952 | Valente | 40/132 |
| 2,677,751 | 5/1954 | Marchand | 240/4.1 |
| 3,038,771 | 6/1962 | Schwartz et al. | 312/223 |
| 3,081,397 | 3/1963 | Tantillo et al. | 240/4.1 |
| 3,301,622 | 1/1967 | Dasovic et al. | 312/245 |
| 3,381,120 | 4/1968 | Fleisher et al. | 362/136 |
| 3,780,281 | 12/1973 | Ohlhauser et al. | 240/4.1 |
| 4,032,774 | 6/1977 | Spicer | 240/73 LD |
| 4,058,718 | 11/1977 | Palka | 362/235 |
| 4,338,653 | 7/1982 | Marrero | 362/223 |
| 4,376,966 | 3/1983 | Tieszen | 362/249 |
| 4,385,346 | 5/1983 | Spicer | 362/382 |
| 4,396,249 | 8/1983 | Aisley | 350/306 |
| 4,471,415 | 9/1984 | Larson et al. | 362/250 |
| 4,569,004 | 2/1986 | Peterson | 362/216 |
| 4,620,268 | 10/1986 | Ferenc | 362/74 |
| 4,728,161 | 3/1988 | Murphy | 312/328 |
| 4,750,794 | 6/1988 | Vegh | 312/263 |
| 4,752,863 | 6/1988 | Parrot | 362/128 |
| 4,812,954 | 3/1989 | Marton | 362/134 |
| 4,884,178 | 11/1989 | Roberts | 362/249 |
| 4,907,138 | 3/1990 | Brueggemann et al. | 362/147 |
| 4,951,184 | 8/1990 | Makurof | 362/147 |

FOREIGN PATENT DOCUMENTS

| | | | |
|---|---|---|---|
| 7701730 | 8/1977 | Netherlands | 362/135 |

*Primary Examiner*—Richard R. Cole

*Attorney, Agent, or Firm*—Panitch Schwarze Jacobs & Nadel

[57] ABSTRACT

A light fixture and/or bath cabinet is provided such that the bath cabinet can be surfaced or recessed mounted. Regardless of whether the bath cabinet is surfaced or recessed mounted, side covers and members are provided for covering the mounting hardware and sides of the cabinet and light fixture to present an overall aesthetically pleasing finish. The bath cabinet and light fixture generally avoid the use of hardware by utilizing extruded members which interlock together. When the bath cabinet is recess mounted, the light fixture is secured directly to the mounting wall directly above the cabinet. On the other hand, when the bath cabinet is surface mounted to the wall, the light fixture is secured to the top of the bath cabinet by a clamping member.

9 Claims, 7 Drawing Sheets

BATH CABINET AND LIGHT FIXTURE MOUNTING AND FINISHING APPARATUS

This is a division of application Ser. No. 07/446,511, filed Dec. 5, 1989 now U.S. Pat. No. 5140506

FIELD OF THE INVENTION

This invention relates to a bath cabinet and light fixture mounting and finishing apparatus, and more particularly, to an arrangement for mounting and finishing a bath cabinet and light fixture of the surface or recess mount type.

BACKGROUND OF THE INVENTION

It is well known that bath cabinets may be surface or recess mounted. A surface mounted bath cabinet is secured directly to the surface of a wall. Whereas, a recess mounted bath cabinet has its body recessed within the wall.

When a bath cabinet is surface mounted, the frame and mirrored door stand away from the wall to which the cabinet is mounted by the depth of the body of the cabinet. Consequently, the sides, bottom and top of the cabinet, as well as some of the hardware by which the cabinet is mounted, are exposed to view. In such situations, it is desirable that the side and bottom of the cabinet be masked, or hidden from view, and finished in an aesthetically pleasing manner. The top of the cabinet, because it is ordinarily well above eye level, is of no particular concern aesthetically.

Recess mounted bath cabinets normally are not a problem aesthetically, since the body and hardware of the cabinet is positioned within the wall, they are not in plain view.

Consequently, in the bath cabinet field, there exists a need for a bath cabinet which can be easily adapted to be either surface or recess mounted without sacrificing aesthetics. There further exists a need for a bath cabinet which can be quickly and efficiently converted between a surface or recess mount.

Whether a bath cabinet is surface or recess mounted, it is desirable to provide a light fixture adjacent the face of the cabinet. When the bath cabinet is recess mounted this is easily accomplished, since the light fixture can be mounted to the surface of the mounting wall adjacent the face of the cabinet. However, when the cabinet and light fixture are both surface mounted, problems are created because the light fixture is normally positioned behind the face of the cabinet, thereby reducing the amount of light which is dispersed to the surrounding area.

Therefore, in the light fixture and bath cabinet field there exists a need for a light fixture which can be mounted adjacent the face of a surface mounted bath cabinet. There further exists a need for a light fixture which can be mounted on such a bath cabinet without exposing mounting hardware to view. In addition, there exists a need for a light fixture which is easily assembled, does not expose hardware to view and is aesthetically pleasing.

The present invention provides a bath cabinet and light fixture which can be efficiently converted between a surface or recess type mount. In the surface type mount, the sides of the cabinet are masked and finished by mirrored panels providing the appearance of extensions of the mirrored door or related to it in design. The bottom of the cabinet is finished by a unobjectionable plain panel or bottom member.

The present invention further provides an easily assembled light fixture which is disposed adjacent the face of the bath cabinet, wherein the sides of the bath cabinet and light fixture are masked and finished by mirrored panels, such that mounting hardware and the hike are not exposed to view. The mirrored panels, bottom panel, light fixture and associated hardware can be supplied as a "kit", for ease of installation and use.

SUMMARY OF THE INVENTION

Briefly stated, the present invention comprises a combination cabinet and mounting bracket for securing the cabinet to a surface of a mounting wall. The combination comprises a cabinet having a top wall, a bottom wall, a rear wall and a pair of side walls. A mounting bracket is provided for being secured to the mounting wall and for securing the cabinet to the mounting wall. The mounting bracket includes securing means engaged with the cabinet for supporting and positioning the cabinet on the mounting wall and for preventing the cabinet from moving vertically relative to the mounting wall when the combination is operatively disposed. A bottom member is interposed between the mounting bracket and the cabinet for positioning and retaining the real wall of the cabinet generally parallel and adjacent to the mounting wall whereby the mounting bracket and bottom member secure the cabinet to the surface of the mounting wall when the combination is operatively disposed.

The present invention also includes a light fixture for mounting on a surface of a mounting wall proximate a cabinet. The light fixture comprises a frame member having a back wall for being secured to the mounting wall such that the back wall and mounting wall are in facing engaging relationship. The frame member also includes a top and bottom wall extending outwardly from the back wall at opposite ends thereof. The top wall includes a flange-like member at a distal end thereof. The back wall also includes a flange-like member at a distal end thereof. The top wall flange-like member and the bottom wall flange-like member extend toward each other. A front wall is provided having electrical elements mounted therein for receiving light means for illuminating an area surrounding the front wall. The front wall includes first and second channel-like members positioned thereon. The front wall is releasably secured to the top and bottom walls such that the top wall flange-like member is positioned within the first channel-like member and the bottom wall flange-like member is positioned within the second channel-like member. First and second side covers are provided, each having at least one protrusion extending outwardly therefrom. The first side cover is releasably positioned on one end of the frame member with the protrusion being frictionally secured to said top or bottom wall. The second side cover is releasably positioned on the other end of the frame member with the protrusion being frictionally secured to the top or bottom wall whereby when the light fixture is assembled, said flange-like members, said channel-like members and said protrusions are not exposed to view.

The present invention further comprises a combination cabinet and light fixture, wherein the cabinet is secured to a surface of a mounting wall. The combination comprises a cabinet having a top wall, a bottom wall, a rear wall, and pair of side walls and a cabinet frame. The cabinet frame includes a flange extending toward the rear wall. A light fixture is provided and includes a frame member for supporting electrical elements thereon. The light fixture is positioned on the cabinet such that the light fixture is spaced from the rear wall. At least one clamping member having a first end is secured to the flange and a second end secured to the frame member such that the light fixture is releasably secured to the cabinet frame whereby the light fixture is not in engagement with the mounting wall when the combination is operatively disposed.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings, embodiments which are presently preferred, it being understood, however, that the invention is not limited to the specific methods and instrumentalities disclosed. In the drawings.

DESCRIPTION OF PREFERRED EMBODIMENTS

Figure 1:
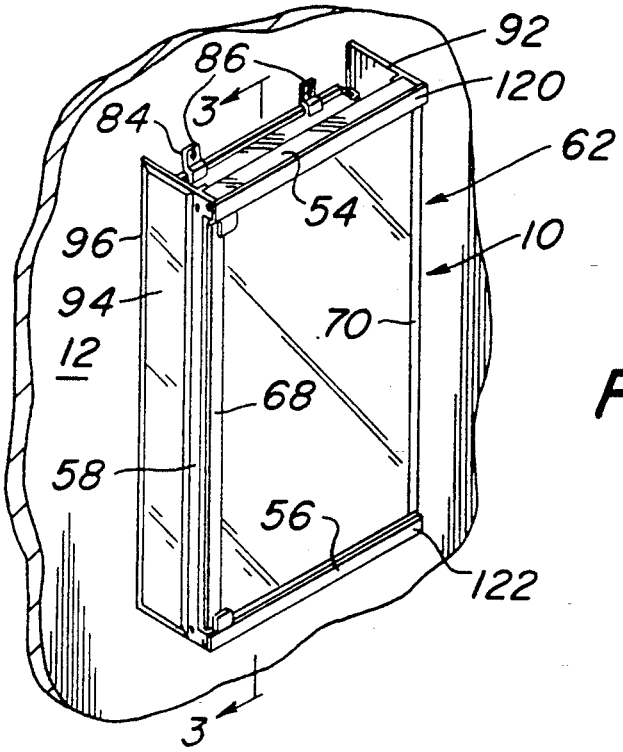
FIG. 1 is a top perspective view of a bath cabinet in accordance with a first preferred embodiment of the present invention shown in the surface mount configuration.

Certain terminology is used in the following description for convenience only and is not limiting. The words "right," "left," "lower" and "upper" designate directions in the drawings to which reference is made. The words "inwardly" and "outwardly" refer to directions toward and away from respectively, the geometric center of the bath cabinet, the light fixture and designated parts thereof. The terminology includes the words above specifically mentioned, derivatives thereof and words of similar import.

Referring now to the drawings in detail, wherein like numerals indicate like elements throughout, there is shown in FIGS. 1 through 4 a first preferred embodiment of a bath cabinet, generally designated 10, shown in the surface mounted configuration. As shown in FIG. 1, the cabinet 10 is surface mounted on a mounting wall 12.

Figure 2:
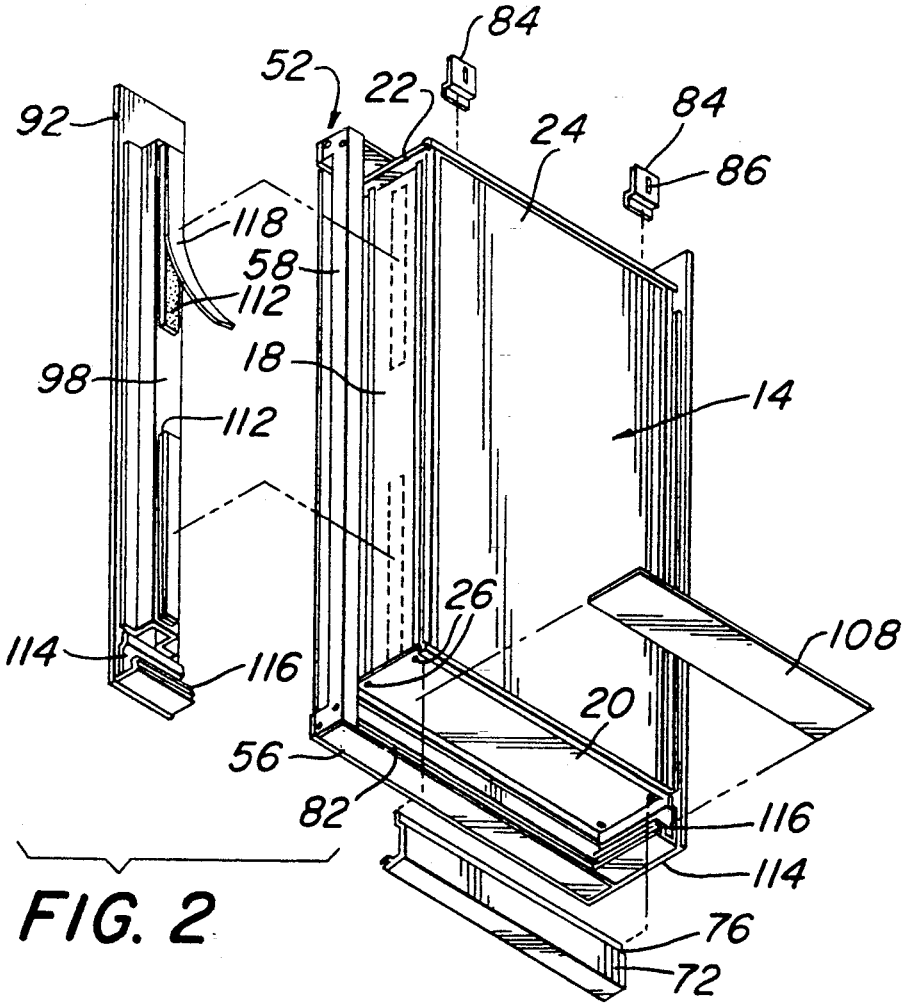
FIG. 2 is an enlarged partially exploded rear perspective view of the bath cabinet of FIG. 1.

Referring now to FIG. 2, the cabinet 10 preferably comprises a hollow body member, generally designated 14, which includes a pair of respective side wall members 16 and 18 (the former is not shown in FIG. 2), a bottom wall member 20, a top wall member 22 and a rear wall panel 24.

In the present embodiment, it is preferred that the side wall members 16 and 18, bottom wall member 20 and top wall member 22 be constructed of a lightweight high strength metallic material, such as aluminum. More particularly, it is preferred that the side wall members 16 and 18 and bottom and top wall members 20 and 22, respectively, be extruded in the same general configuration. However, it is understood by those skilled in the art, that other processes and materials can be used to construct the various wall members and that the wall members can be of different shapes without departing from the spirit and scope of the invention. For instance, the wall members 16, 18, 20 and 22 could be constructed of a cast metallic material or wood.

In the present embodiment, it is preferred that the rear wall panel 24 be constructed of a natural material, such as wood. For instance, the rear wall panel 24 could be constructed of a thin plywood or other like material. However, it is understood by those skilled in the art, that the rear wall panel 24 could be constructed of other materials, such as a metallic or polymeric material.

Figure 4:
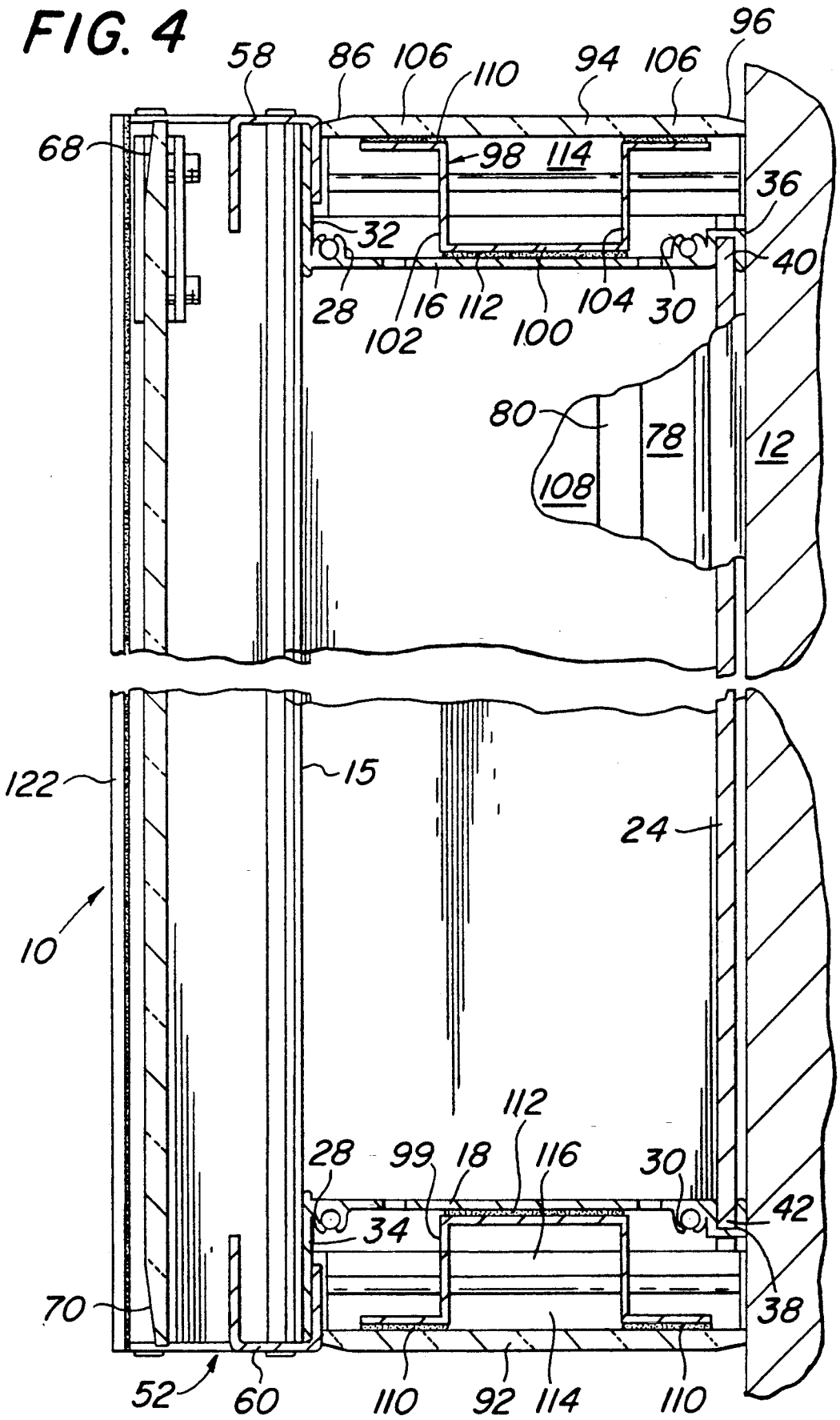
FIG. 4 is a greatly enlarged cross-sectional view partially broken away of the bath cabinet of FIG. 3 taken along line 4—4 of FIG. 3.

Referring now to FIGS. 2 and 4, in the present embodiment, the bottom and top wall members 20 and 22 are preferably secured to the side wall members 16 and 18 by means of screws 26. The screws 26 preferably pass through generally vertically extending pre-drilled holes in the bottom and top wall members 20 and 22 into suitably sized semi-circular channels 28 and 30 located on the outer periphery of the side wall members 16 and 18 which are adapted to receive them. However, it is understood by those skilled in the art that the body member 14 and its respective wall members can be secured together through other means, such as welding.

As shown in FIG. 4, the side wall members 16 and 18 are preferably provided with generally vertically oriented flanges 32 and 3 which project laterally in a plane generally parallel to the plane of the opening 15 of the body member 14. The side wall members 16 and 18 further include respectively open-mouthed channels 36 and 38 which face each other and are oriented to engage respective vertical edges 40 and 42 of the rear wall 24.

Figure 3:
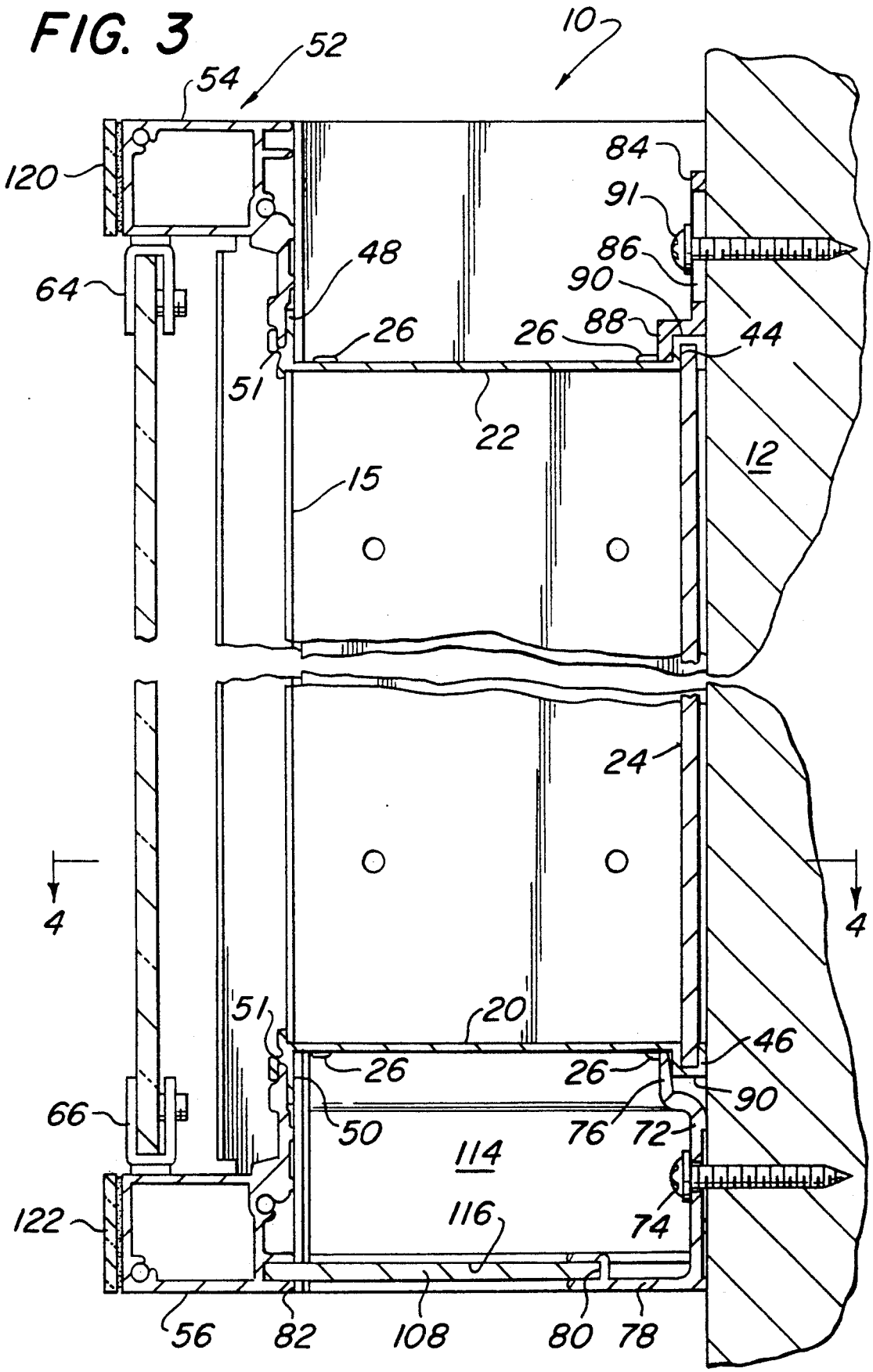
FIG. 3 is a greatly enlarged cross-sectional view of the bath cabinet of FIG. 1 taken along line 3—3 of FIG. 1.

As shown in FIG. 3, the bottom wall member 20 and the top wall member 22 also include open-mouthed channels 46 and 44, respectively, for receiving the horizontal edges of the rear wall 24. Additionally, the bottom wall and top wall members 20 and 22 also include, respectively, generally vertically oriented fascia panels 50 and 48, described in more detail hereinafter.

As shown in FIGS. 3 and 4, a cabinet frame 52 is preferably associated with the body member 14. More particularly, the frame 52 is coupled or interlocked to the flanges 32 and 34 and the fascia panels 48 and 50. The frame 52 is preferably comprised of an upper generally horizontal member 54 and a lower generally horizontal member 56. The upper and lower members 54 and 56 are interconnected by a pair of generally vertical frame members 58 and 60. The generally vertical frame members 58 and 60 are coupled or interlocked to the flanges 32, 34 and the upper and lower members 54 and 56 are coupled or interlocked to a groove 51 in the fascia panels 48 and 50 for securing the frame 52 to the body member 14, as shown in FIGS. 3 and 4.

In the present embodiment, it is preferred that frame 52 be constructed of a light-weight high strength metallic material, such as aluminum. More particularly, it is preferred that the upper and lower members 54 and 56 and the vertical frame members 58 and 60 be extruded members which are interlocked together without the use of standard hardware. However, it is understood by those skilled in the art, that the frame 52 could be welded together or constructed of other materials, such as polyvinylchloride or wood.

As shown in FIGS. 1 and 4, the frame 52 includes a door 62, preferably in the form of a generally planar mirror, hingedly connected to the frame 52 in generally parallel juxtaposition to the opening 15 of the body member 14. The mirrored door 62 is preferably mounted to the upper member 54 and lower member 56 by respective hinges 64 and 66, as is understood by those skilled in the art, as shown in FIGS. 1 and 3. In the present embodiment, it is preferred that the mirror door 62 be of any conventional construction as is known to those skilled in the art. For instance, the mirrored door 62 can be framed, unframed, self-supporting or include beveled edges 68 and 70, as shown in FIGS. 1 and 4.

Referring now to FIGS. 2 and 3, the bath cabinet 10 is shown affixed to the mounting wall 12. A mounting bracket 72 is provided for being fixedly secured to the mounting wall 12 and for securing the cabinet 10 to the mounting wall 12. The mounting bracket 72 is secured to the mounting wall 12 by a suitable number of fasteners or anchors, such as screws 74. As is understood by those skilled in the art, it is preferred that conventional self-tapping screws be used where studs are available and where studs are not available, the mounting bracket 72 is preferably affixed to the mounting wall 12 by means of conventional anchors, such as molly bolts (not shown).

The mounting bracket includes securing means engaged with the cabinet 10 for supporting and positioning the cabinet 10 on the mounting wall 12 and for preventing the cabinet from moving vertically relative to the mounting wall 12 when the cabinet 10 and the mounting bracket 72 are operatively disposed on the mounting wall 12.

Referring now to FIG. 3, in the present embodiment, the securing means preferably comprises a flange 76 extending generally upwardly from the mounting bracket 72. The flange 76 is preferably offset from the body of the mounting bracket 72 by a distance which generally corresponds to the external dimension of the ridge 90 defined by the bottom of the channel 46. Engagement of the channel 46 and the flange 76 secures or clamps the bottom of the body member 14 to the mounting wall 12 for preventing the cabinet 10 from moving vertically with respect to the mounting wall 12.

As shown in FIG. 3, the mounting bracket 72 is generally L-shaped in cross section and has a horizontal length approximately equal to the horizontal length of the rear wall 24. It is understood by those skilled in the art, that the mounting bracket 72 can be comprised of a plurality of mounting brackets interspersed along the horizontal length of the cabinet 10, without departing from the spirit and scope of the invention.

In the present embodiment it is preferred that the mounting bracket 72 include a generally horizontal flange 78. Preferably, the distal extremity of the flange 78 defines a generally U-shaped channel 80 in cross section. The channel 80 is spaced from and aligned with a generally identical channel 82 formed in the lower member 56 of the frame 52, as described hereinafter.

As shown in FIGS. 1 and 3, the top of the body member 14 is secured to the mounting wall 12 by attachment means. In the present embodiment, it is preferred that the attachment means comprise a pair of brackets or clips 84 which include generally vertically extending elongated slots 86 to facilitate positioning of the clips 84. The clips 84, like the above-described mounting bracket 72, include an offset flange 88 for receiving the ridge 90 defined by the channel 44 of the top wall member 22, when the clip 84 is secured to the mounting wall 12, as shown in FIG. 3. The clips 84 are preferably secured to the mounting wall 12 by any suitable fastener such as self-tapping screws 91 or molly bolts (not shown), as described above in connection with the mounting bracket 72.

Referring now to FIGS. 1, 2 and 4, there is shown a pair of side members 92 and 94. Each side member 92 and 94 is secured to the cabinet 10 adjacent one of the side walls 16 and 18 for providing the cabinet 10 with a finished appearance. In the present embodiment, it is preferred that the side members 92 and 94 be mirrors, as shown in FIG. 1. Further, the mirrors preferably include beveled edges 96 for providing an aesthetically pleasing finish. However, it is understood by those skilled in the art, that the side members 92 and 94 can be constructed of other materials, such as a polymeric material, wood and/or include decorative markings for enhancing the overall appearance of the cabinet 10.

In the present embodiment, it is preferred that the side members 92 and 94 have a vertical length which is approximately equal to the vertical length of the frame 52, as shown in FIG. 1. Similarly, it is preferred that the side mirrors 92 and 94 have a width which generally corresponds to the spacing between either of the vertical frame members 58 or 60 of the frame 52 and the mounting wall 12 when the cabinet 10 is surface mounted.

In the present embodiment, it is preferred that the side members 92 and 94 be spaced from the side wall members 16 and 18, respectively, by a distance corresponding to the distance between the face of the side wall members 16 and 18 and the lateral edge of the vertical frame members 58 and 60. As shown in FIGS. 2 and 4, this spacing is preferably achieved by providing on a back or inside face of the side member 94, a longitudinally extending channel member 98. In cross section, the channel member 98 is preferably configured to include a rear web 10 which extends generally parallel to the plane of the side member 94; a pair of webs 102, 104 extending generally perpendicularly from the rear web 100; and a pair of flanges 106 extending generally perpendicularly with respect to the webs 102 and 104 and generally parallel to the plane of the side member 94. The other side member 92 also preferably includes a generally identical channel member 99. Consequently, further description thereof is neither necessary nor limiting.

As shown in FIGS. 2 and 4, the channel members 98 and 99 are preferably secured to the side members 92 and 94, respectively, with an adhesive. Similarly, each channel member 98 and 99 is adhesively secured to the side wall members 16 and 18, respectively. In the present embodiment, it is preferred that the channel member 98 be affixed to the rear face of the side member 94, by means of two-faced pressure sensitive tape 110. Similarly, the rear web 100 of the channel member 98 is affixed by two-faced secured sensitive tape 112 to the side wall member 16. It is understood by those skilled in the art, that the other side member 92 is similarly configured and secured to the side wall member 18. It is also understood by those skilled in the art, that other means can be provided for securing the side members 92 and 94 to the channel members 98 and 99 and for securing the channel members 98 and 99 to the side wall members 16 and 18, such as a quick setting epoxy resin or standard fasteners.

Referring now to FIGS. 2 and 3, each of the side members 92 and 94 include a side bracket 114 secured thereto. The side bracket 114 is generally "L" shaped in cross section and is preferably generally identical to the mounting bracket 72 except it is shorter in length to correspond to the width of the side members 92 and 94. The side bracket 114 preferably includes an open-mouth channel 116 which is juxtaposed to the channel 80 associated with mounting bracket 72 when the cabinet 10 is operatively disposed.

As shown in FIG. 3, a bottom member or panel 108 is interposed between the mounting bracket 72 and the cabinet 10 for positioning and retaining the rear wall 24 of the cabinet 10 generally parallel and adjacent to the mounting wall 12 such that mounting bracket 72 and bottom member 108 secure the cabinet 10 to the surface of the mounting wall 12 when the cabinet is operatively disposed, as described in more detail hereinafter.

As shown in FIG. 2, the channel 80 in the mounting bracket 72, the channel 82 formed in the lower frame member 56 and the channels 116 associated with the side brackets 114 provide a slot which receives and securely retains the bottom member 10B when the cabinet 10 is secured to the mounting wall 12. As shown in FIG. 3, the bottom member 108 is spaced from or below the bottom wall member 20 of the body member 14.

The bottom member 108 is preferably constructed of a relatively inexpensive material such as polyvinylchloride. However, it is understood by those skilled in the art, that the bottom member 108 can be constructed of other materials, such as wood or a metallic material. The bottom member 108 preferably has a thickness which corresponds to the width of the channels 80, 82 and 116, for providing a juction fit.

To install the cabinet 10 on the mounting wall 12, the mounting bracket 72 is secured to the mounting wall 12, as described above, in a position which will locate the cabinet 10 on the mounting wall at the user's desired location. The bottom member 108 is then friction-fitted into the channel 82. The cabinet 10 is then lifted and fitted downwardly behind the flange 76 of the mounting bracket 72, while the bottom member 108 is guided into the channel 80 of the mounting bracket 72.

The retaining clips 84 are then loosely applied to the top section of the bath cabinet as needed, to further secure the cabinet 10 to the mounting wall 12. The side members 92 and 94 are then loosely fitted to the side wall members 16 and 18 of the cabinet 10 with the channel 116 of the side brackets 114 engaged with the side edges of the bottom member 108. If the installer is satisfied with the position of the side members 92 and 94, the conventional protective strips 118 (as shown in FIG. 2) associated with one face of the tape 112 is removed and the side members 92 and 94 are adhesively secured to the side wall members 16 and 18.

The appearance of the face of the bath cabinet 10 may be enhanced if desired, by mirror strips 120 and 122 preapplied to the faces of the upper and lower frame members 54 and 56. Such strips, in conjunction with the mirror door 62 and the side mirrors 92 and 94, give the bath cabinet 10 a pleasing overall "finished" aspect.

Figure 6:
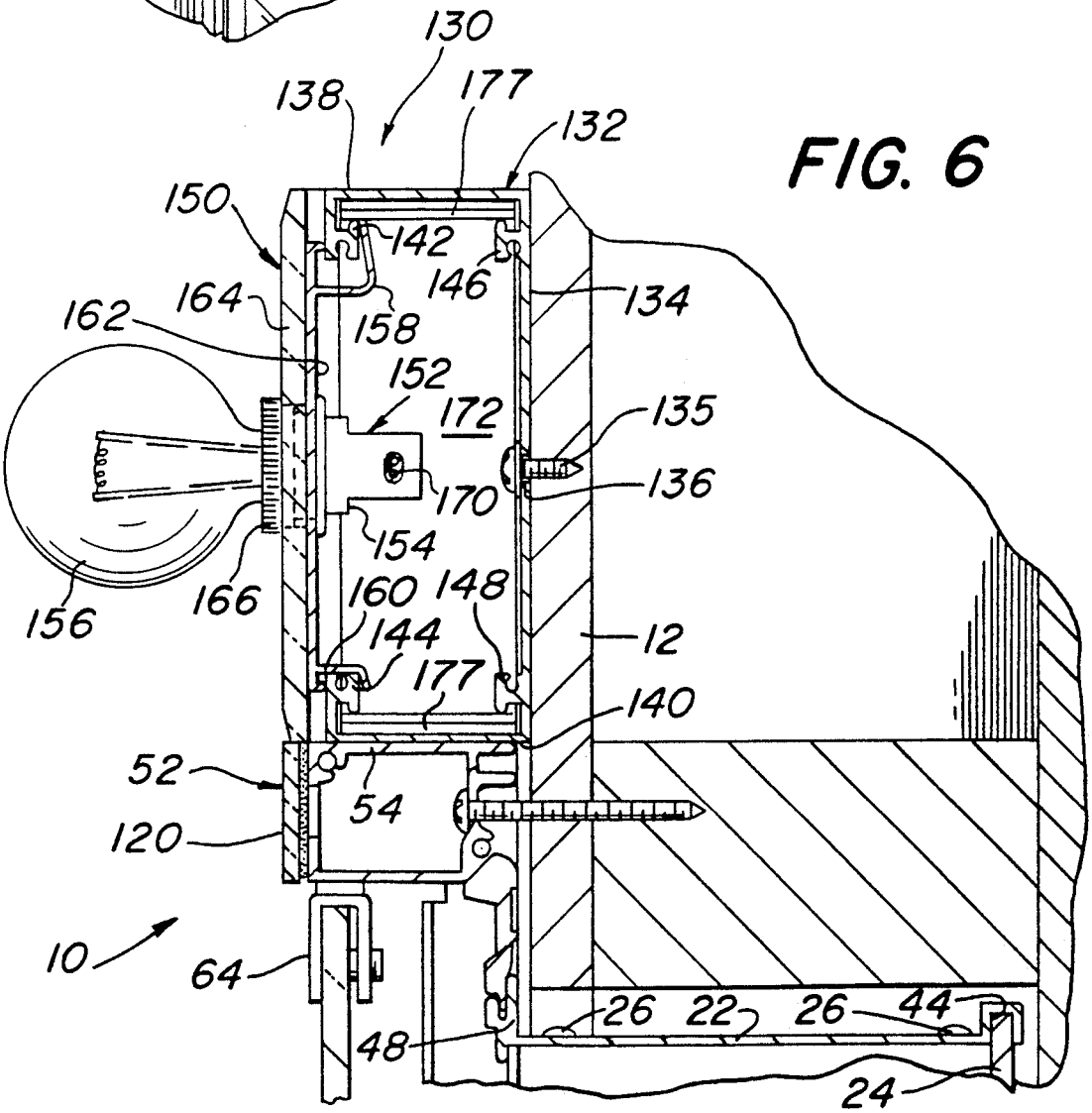
FIG. 6 is a greatly enlarged cross-sectional view of the bath cabinet and light fixture of FIG. 5 taken along line 6—6 of FIG. 5.

When the bath cabinet 10 is recess mounted within the mounting wall 12 the side members 92 and 94, as well as the bottom member 108 are not used. The cabinet 10 is preferably positioned within the mounting wall 12 such that the frame 52 engages the surface of the mounting wall 12, as is understood by those skilled in the art. To secure the cabinet 10 in the recessed position, screws 53 are positioned through holes in the upper and lower members 54 and 56 into the mounting wall 12 and preferably a stud 55 on the other side thereof, as shown in FIG. 6. Alternatively, the cabinet 10 could be mounted with molly bolts (not shown), as is understood by those skilled in the art.

Figure 5:
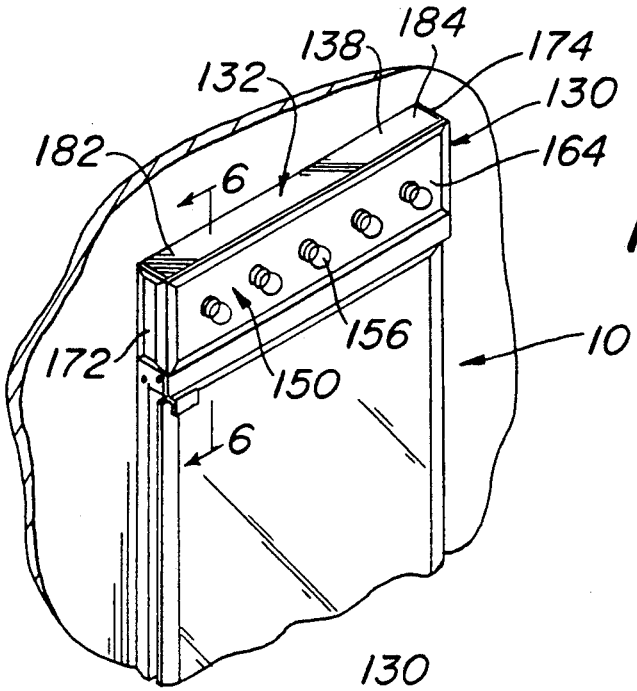
FIG. 5 is a top perspective view of a surface mounted light fixture in accordance with a second preferred embodiment of the present invention shown in conjunction with the bath cabinet of FIGS. 1-4 in the recess mount configuration.

Referring now to FIGS. 5–11, there is shown a light fixture 130 in accordance with a second preferred embodiment of the invention. Referring to FIGS. 5 and 6, the light fixture 130 is shown in the surface mount position. The light fixture 130 is preferably positioned directly above the recess mounted bath cabinet 10 for maximum light efficiency. It is understood by those skilled in the art, that the light fixture 130 can be mounted to the side of the bath cabinet 10 or at a position spaced from the bath cabinet 10, as is apparent from the description hereinafter.

Referring now to FIGS. 5 and 6, the light fixture includes a frame member 132 having a back wall 134 for being secured to the mounting wall 12 such that the back wall 134 and mounting wall 12 are in facing engaging relationship. The back wall 134 preferably includes at least one aperture 136 therein for receiving a fastener element therethrough to be anchored in the mounting wall 12. In the second preferred embodiment, the fastener element is preferably a self-tapping screw 135 or molly bolt (not shown), depending upon the type of wall to which the light fixture 130 is mounted. However, it is understood by those skilled in the art, that other means could be employed for securing the light fixture 130 to the mounting wall 12. For instance, double sided adhesive tape could be disposed between the back wall 134 and mounting wall 112.

As best shown in FIG. 6, the frame member 132 further includes a top and bottom wall 138 and 140, respectively, extending outwardly from the back wall 134 at opposite ends thereof. More particularly, the top and bottom walls 138 and 140 extend generally perpendicularly from the back wall 134. In the present embodiment, it is preferred that the frame member 132 be constructed of a single extruded member which is generally "U" shaped in cross section. However, it is understood by those skilled in the art that the frame member 132 can be constructed in other manners and configured in other shapes, such as semi-circular or semioctagonal.

The frame member 132 is preferably constructed of a lightweight high strength metallic material, such as steel or aluminum. However, it is understood by those skilled in the art, that the frame member 132 can be constructed of a polymeric material, such as polyvinylchloride, wood or other like material, without departing from the spirit and scope of the invention. Furthermore, for ease of description only, the remaining elements or parts of the bath cabinet 10 and light fixture 130 which are designated as being extrudable, are similarly constructed of the same materials.

As shown in FIG. 6, the top wall 138 includes a flange-like member 142 extending therefrom at a distal end thereof. Similarly, the bottom wall 140 includes a flange-like member 144 extending therefrom at a distal end thereof. The top wall flange-like member 142 and bottom wall flange-like member 144 preferably extend toward each other. Additionally, the frame member 132 further includes an inwardly extending top rib-like member 146 and an inwardly extending bottom rib-like member 148 positioned proximate the top and bottom walls 138 and 140, respectively. More particularly, the top rib-like member 146 and bottom rib-like member 148 are integrally connected to the back wall 134.

As shown in FIGS. 5 and 6, the light fixture 130 preferably includes a front wall 150 having electrical elements, generally designated 152, mounted therein for receiving light means for illuminating an area surrounding the front wall 150. In the present embodiment, it is preferred that the electrical elements 152 comprise standard light bulb sockets 154 connected to an electrical source as is understood by those skilled in the art. Similarly, it is preferred that the light means be light bulbs 156 positioned within the sockets 154, as is understood by those skilled in the art.

It is appreciated by the ordinarily skilled artisan that the present invention is not limited to the type of electrical elements and light means employed with the light fixture 130. That is, it is appreciated that other electrical elements and light means could be used and attached to the front wall 150 without departing from the spirit and scope of the invention. For instance, a fluorescent bulb (not shown) could be disposed generally horizontally across the face of the front wall 150. Consequently, further description of the electrical elements and light means is not necessary and, therefore, is not limiting.

Referring now to FIG. 6, the front wall 150 includes a first and second channel-like member 158 and 160, respectively, positioned thereon. The front wall 150 is preferably releasably secured to the top and bottom walls 138 and 140 such that the top wall flange-like member 142 is positioned within the first channel-like member 158 and the bottom wall flange-like member 144 is positioned within the second channel-like member 160. In the present embodiment, it is preferred that the first channel-like member 158 be larger or have a greater depth than the second channel-like member 160 for allowing the front wall 150 to be interlocked to the top and bottom walls 138 and 140, as is apparent from the description hereinafter.

As shown in FIG. 6, the front wall is preferably comprised of a support wall or extruded member 162, wherein the first and second channel-like members 158 and 160 are integrally extruded therewith. Preferably, the front wall 150 includes a mirror panel 164 secured to the extruded member 162 preferably by at least one screw ring 166 threadably secured to a correspondingly threaded section of the electric socket 154. However, it is understood by those skilled in the art, that the mirror panel 164 could be secured to the extruded member 162 by other means such as an adhesive. It is also understood by those skilled in the art, that other decorative-type panels could be secured to the extruded member 162, such as wood or brass panels.

As shown in FIG. 5, the front wall 150 is preferably sized to extend completely between the top and bottom walls 138 and 140. Similarly, it is preferred that the top, bottom, front and back walls 138, 140, 150 and 134 are each of the same general horizontal length for providing the light fixture 132 with an overall aesthetically pleasing appearance.

Figure 10:
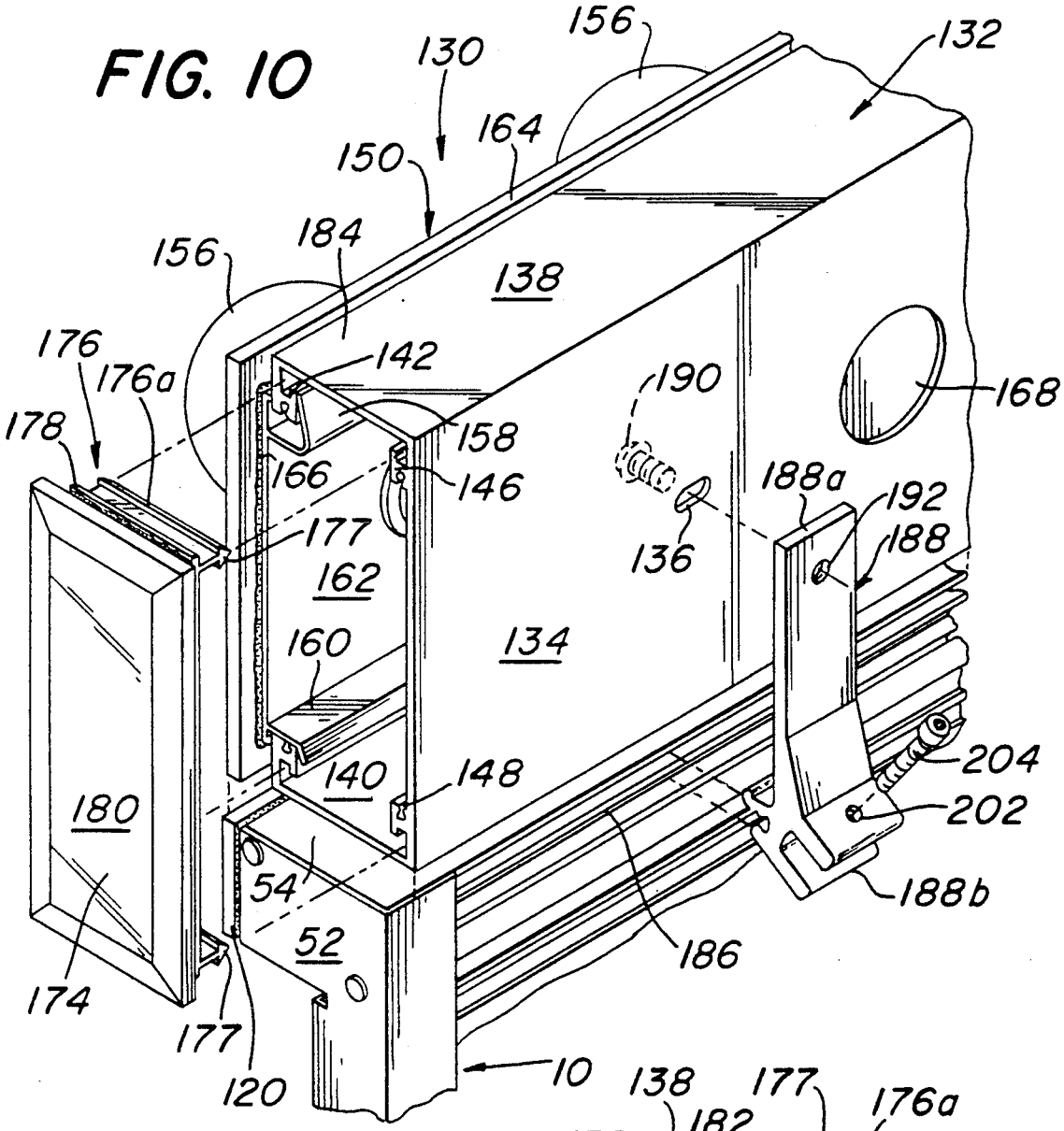
FIG. 10 is a greatly enlarged rear perspective view, partially exploded, of the bath cabinet and light fixture of FIG. 7.

As shown in FIG. 10, the frame member 132 preferably further includes a second aperture 168 in the back wall 134 for receiving electrical wires 170 therethrough for electrical communication with the electrical elements 152. However, it is understood by those skilled in the art, that the second aperture 168 could be located anywhere along the frame member 132, such as in the top wall 138, without departing from the spirit and scope of the invention.

Figure 9:
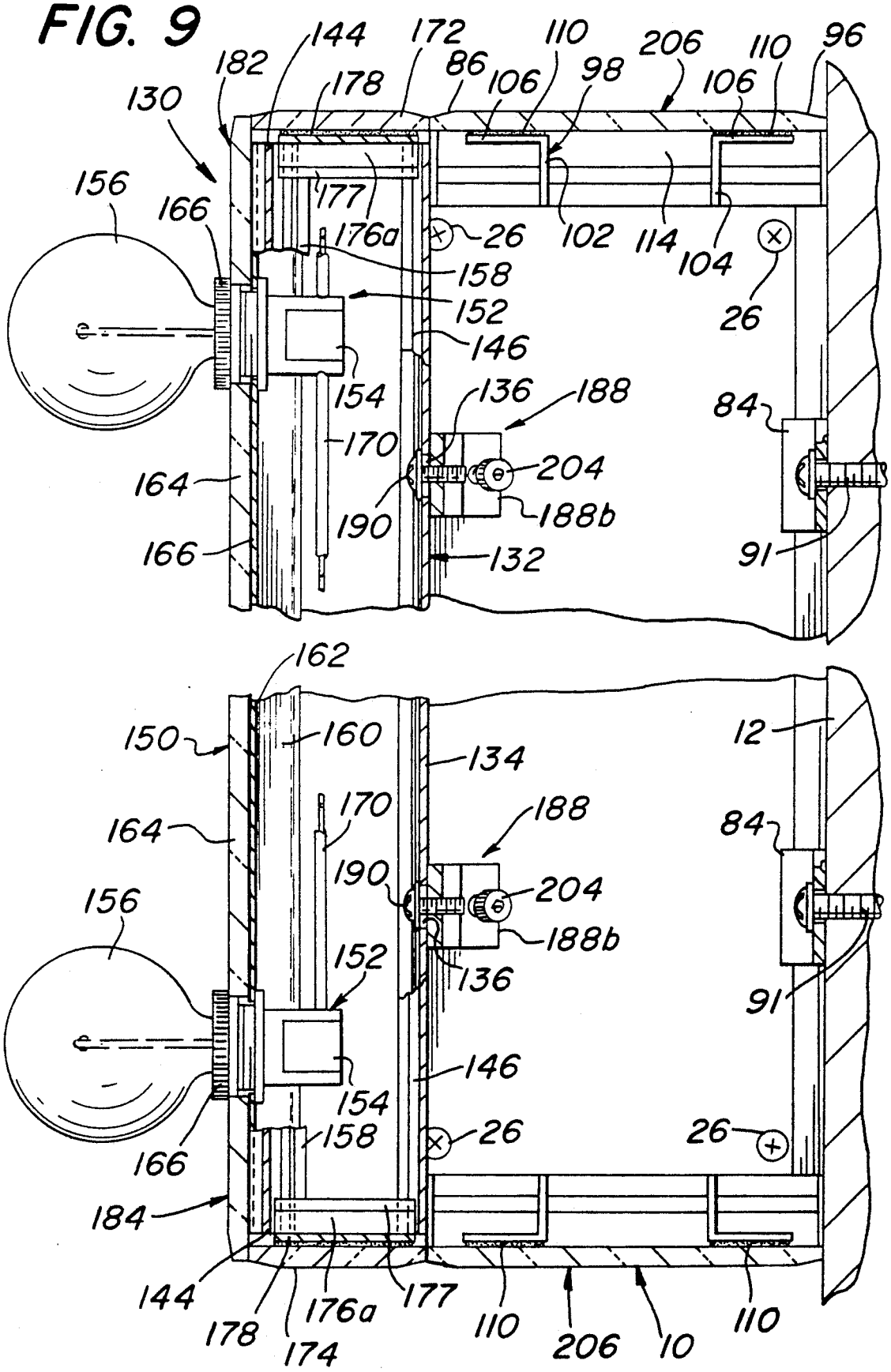
FIG. 9 is a cross-sectional view, partially broken away, of the bath cabinet and light fixture of FIG. 8 taken along line 9—9 of FIG. 8.
Figure 11:
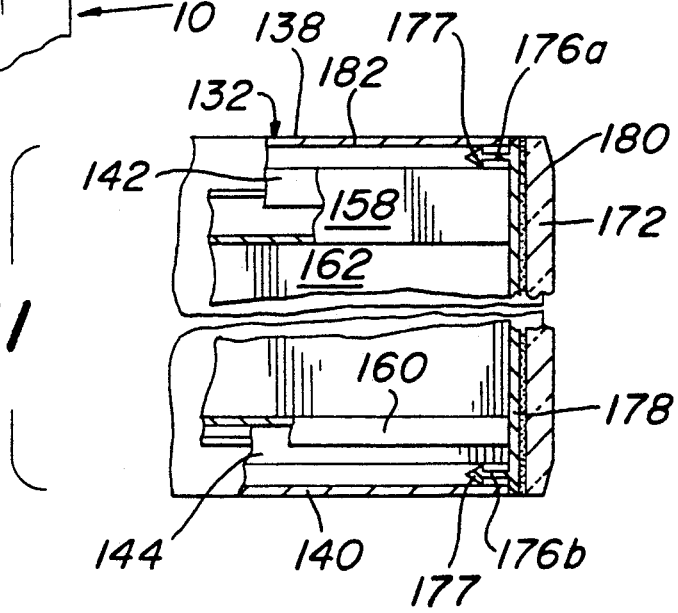
FIG. 11 is a cross-sectional view of the light fixture of FIG. 8 taken along line 11—11 of FIG. 8.

Referring now to FIGS. 9, 10 and 11, there is shown first and second side covers 172 and 174, each having at least one protrusion 176 extending outwardly therefrom. More particularly, it is preferred that the first and second side covers 172 and 174 each include a first protrusion **176*a* and a second protrusions 176*b* located at opposite ends of the side covers 172 and 174 and extending outwardly therefrom. In the present embodiment, it is preferred that the side covers 172 and 174 be constructed of a wall panel 178 formed by an extrusion process. More particularly, it is preferred that the protrusions 176*a* and 176*b* and the wall panel 178** be extruded as a single piece.

Preferably, a mirror panel 180 is secured to the face of the wall panel 178 opposite to the face from which the protrusions **176*a* and 176*b* extend from. As with the mirror panel 164 associated with the front wall 150, other types of decorative panels could be secured to the wall panel 178. As shown in FIG. 5, the first and second side covers 172 and 174 are preferably sized to correspond or compliment the top wall 138, bottom wall 140, front wall 150 and back wall 134, for maintaining the protrusions 176*a* and 176*b* and the interior of the frame member 132 out of view. The mirrored panel 180 is preferably secured to the wall panel 178** with adhesive means, such as double-sided adhesive tape.

In the present embodiment, it is preferred that the first side cover 172 be releasably positioned on one end 182 of the frame member 132 and the second side cover 174 be releasably positioned on the other end 184 of the frame member 132. Consequently, as mentioned previously, when the light fixture 130 is assembled, the flange-like members 142 and 144, the channel-like members 158 and 160, the rib-like members 146 and 148 and the protrusions 176 are not exposed to view.

As shown in FIG. 11, in the present embodiment, it is preferred that the first protrusion **176*a* be frictionally secured to the top wall 138 and the second protrusion 176*b* be frictionally secured to the bottom wall 140. More particularly, it preferred that the first protrusion 176*a* of each side cover 172 and 174 be frictionally positioned between the top wall 138 and the top wall flange-like member 142 and top rib-like member 146 and the second protrusion 176*b* be frictionally positioned between the bottom wall 140 and the bottom wall flange-like member 144 and bottom rib-like member 148**.

In the present embodiment, it is preferred that the protrusions be generally arrow shaped in cross section. More particularly, it is preferred that the arrow head portion 177 of the protrusions 176*a*, 176*b* have a width which is approximately equal to the distance between the top wall 138 and the top wall flange-like member 142; the top wall 138 and the top rib-like member 146; the bottom wall 140 and the bottom wall flange-like member 144; and the bottom wall 140 and the bottom rib-like member 148 for providing a friction fit therebetween.

To mount the light fixture 130 to the surface of the mounting wall 12, the back wall 134 is positioned in facing engaging relationship with the mounting wall 12 in a desired location and position. In the present embodiment, it is preferred that the bottom wall 140 of the frame member 132 be positioned in abutting relationship with the top of the bath cabinet 10 or upper member 54 for providing maximum lighting to the user. However, as mentioned previously, the light fixture 130 can be positioned at any suitable desirable location, for instance along the sides of the bath cabinet 10.

Before the frame member 132 is secured to the mounting wall 12, the electrical wires (not shown) which provide the light bulbs 156 with current are fed through the second aperture 168 in the back wall 134, and connected to the electrical wires 170. The frame member 132 is then secured to the mounting wall 12 preferably by inserting a screw 135 through the aperture 136, into the mounting wall 12. The number of screws 135 utilized, depends upon the horizontal length of the light fixture 130 as is understood by those skilled in the art.

The front wall 150 is then secured to the top and bottom walls 138 and 140 of the frame member 132. As best shown in FIG. 6, this is accomplished by first attaching the electrical wires and then inserting the top wall flange-like member 142 into the first channel-like member 158 until the first channel-like member 158 engages the top wall 138. The front wall 150 is then pivoted toward the back wall 134 until the second channel-like member 166 is positioned directly over the bottom wall flange-like member 144. The front wall 150 is then lowered or moved downwardly until the second channel-like member 160 engages the bottom wall flange-like member 144, thereby interlocking the front wall 150 to the frame member 132.

The first side cover 172 is then secured to one end 182 of the frame member 132 with the first protrusion 176*a* being frictionally secured to the top wall 138 and the second protrusion 176*b* being frictionally secured to the bottom wall 140, as described above. Similarly, the second side cover 174 is frictionally secured to the other end 184 of the frame member with the first protrusion 178 frictionally secured to the top wall 138 and the second protrusion 176*b* frictionally secured to the bottom wall 140.

Consequently, the light fixture 130 is easily assembled and does not expose the connecting hardware to view and is, therefore, aesthetically pleasing.

Figure 7:
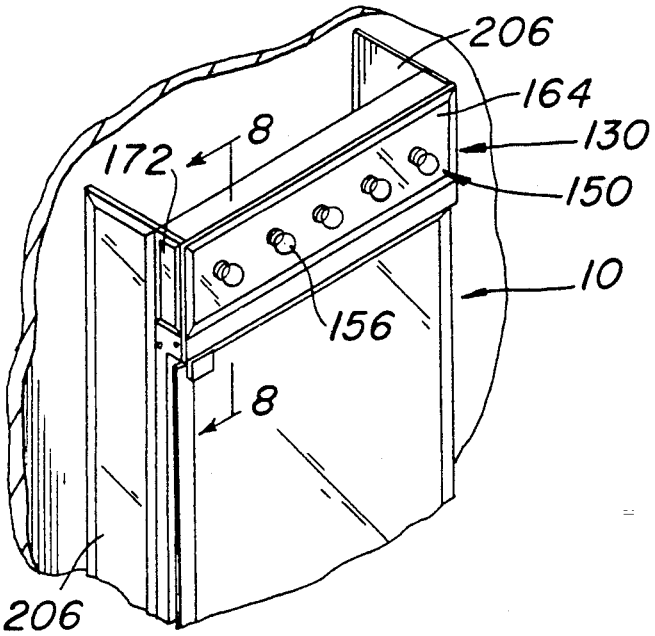
FIG. 7 is a top perspective view of a bath cabinet and the light fixture of FIG. 5 in accordance with a third preferred embodiment of the present invention shown in the surface mount configuration.
Figure 8:
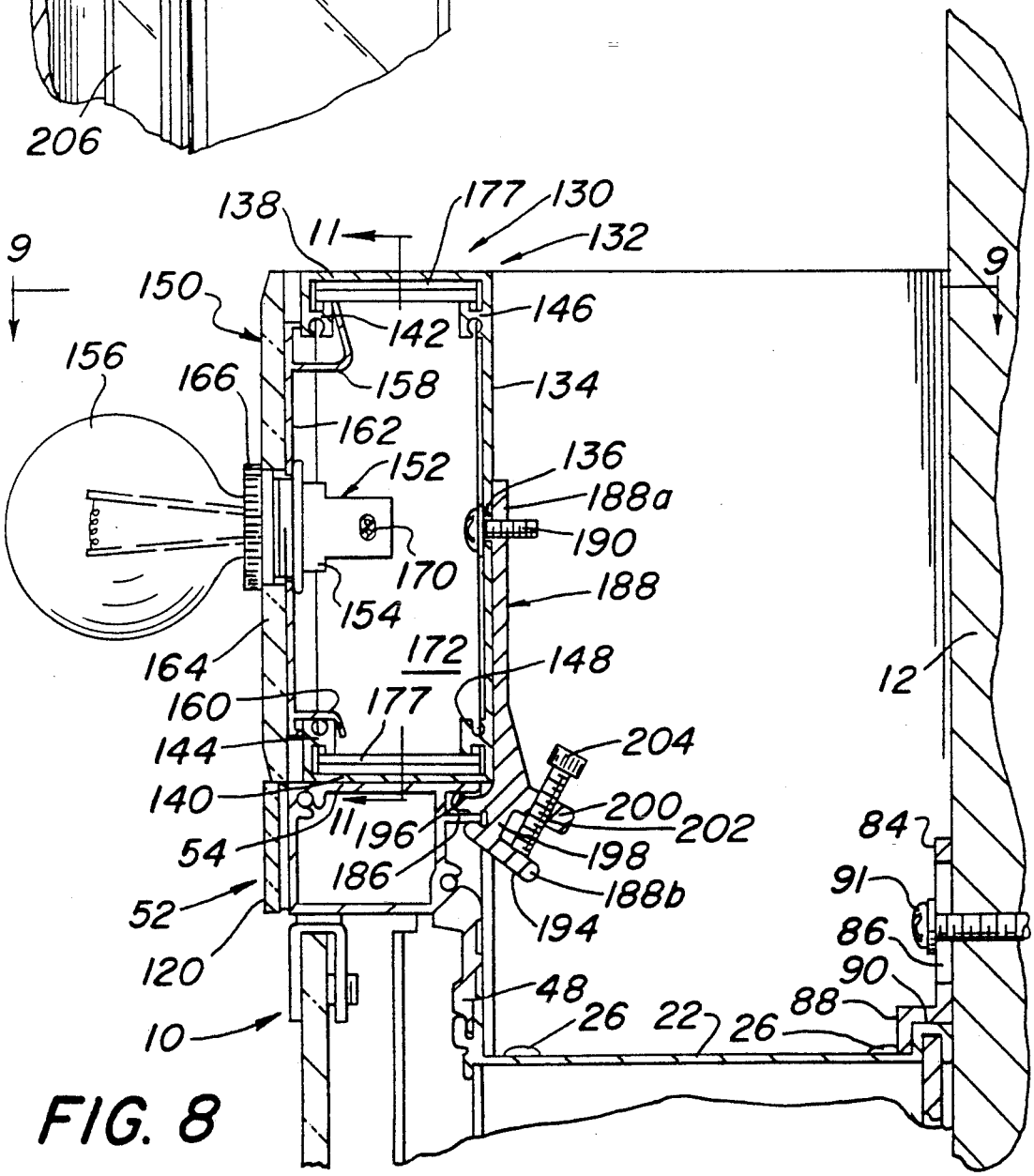
FIG. 8 is a greatly enlarged cross-sectional view of the bath cabinet and light fixture of FIG. 7 taken along lines 8—8 of FIG. 7.

Referring now to FIGS. 7–11, there is shown the bath cabinet 10 and the light fixture 130 in accordance with a third preferred embodiment of the invention. In the third preferred embodiment, it is preferred that the bath cabinet 10 be surfaced mounted to a mounting wall 12 with the light fixture 130 secured thereto, as shown in FIG. 8.

In the third preferred embodiment, the cabinet 10 preferably includes a top wall 22, a bottom wall 20 and rear wall 24, a pair of side walls 16 and 18 and a cabinet frame 52. The cabinet frame 52 preferably includes a flange 186 extending toward the rear wall 24. Generally, the bath cabinet 10 is identical to the bath cabinet 10 described above in conjunction with FIGS. 1–4, except as noted. The cabinet frame 52 is preferably spaced from the rear wall 24 by the top, bottom and side walls 22, 20, 16 and 18, respectively. Consequently, in view of the above, repeated or further description of the bath cabinet 10 is unnecessary and, therefore, not limiting.

As shown in FIG. 8, the light fixture 130 is positioned on the cabinet 10 such that the light fixture 130 is spaced from the rear wall 24. More particularly, the light fixture 130 is secured to the top of the cabinet frame 52 with the bottom wall 140 in abutting relationship with the upper member 54 for providing maximum light to the user. In the present embodiment, it is preferred that the light fixture 130 be generally identical to that described above, except as noted, consequently, further description thereof is unnecessary and not limiting.

As shown in FIGS. 8, 9 and 10, the light fixture 130 is secured to the cabinet 10 by at least one clamping member 188 having a first end 188*a* secured to the frame member 132 and a second end 186*b* secured to the flange 186 such that the light fixture 130 is releasably secured to the cabinet frame 52 whereby the light fixture 130 is not in engagement with the mounting wall 12 when the light fixture 130 and cabinet 10 are operatively disposed.

The present invention is not limited to any number of clamping members disposed across the horizontal length of the lighting fixture 130. It is appreciated by those skilled in the art, that while the present embodiment preferably utilizes two clamping members spaced equadistantly across the length of the light fixture 130, any number of clamping members 188 can be used without departing from the spirit and scope of the invention. The following description is directed to a single clamping member 188, but it is understood that it is equally applicable to all of the clamping members 188 utilized.

As shown in FIGS. 8 and 10, the first end 188*a* of the clamping member 188 is preferably suitably positioned in alignment with the aperture 136. A fastener element 190 is positioned through the aperture 136 and is secured to the first end 188*a* of the clamping member 188 to attach the clamping member 188 to the frame member 132. More particularly, as shown in FIG. 10, it is preferred that the fastener element 190 be a threaded member, such as a screw, and that the first end 188*a* of the clamping member 188 include a correspondingly and suitably sized thread hole 19 for threadably receiving the threaded member or screw. However, it is understood by those skilled in the art, that other means and instrumentalities can be used to secure the first end 188*a* of the clamping member 188 to the back wall 134 of the frame member 132. For instance, the first end 188*a* could include a perpendicularly protruding member (not shown) which could frictionally engage a hole in the back wall 134, without departing from the spirit and scope of the invention.

As shown in FIG. 8, the second end 188*b* of the clamping member 188 includes a first leg 194 positioned on one side of the flange 186 and is engaged therewith. The clamping member 188 also includes a second leg 196 positioned on the other side of the flange 186 and engaged therewith. Means are provided for moving one of the legs 194 and 196 with respect to the other leg to firmly grip the flange 186. The first leg 194 is preferably interconnected to the second leg 196 by a common area 198. A base member 200 preferably extends from the clamping member 188 and has a threaded hole 202 generally centrally disposed therein above the first leg 194. A threaded member 204 is preferably threadably disposed within the threaded hole 202 such that the threaded member 204 is in contact with the first leg 194. When the threaded member 204 is rotated, the first leg 194 moves with respect to the second leg 196 against the tension provided by the common area 198 to firmly grip the flange 186.

The clamping member 188 is preferably constructed utilizing an extrusion process of a high strength lightweight metallic material, such as aluminum. However, it is understood by those skilled in the art, that the clamping member 188 can be constructed of other materials, such as steel or a polymeric material, such as polyvinyl-chloride.

Referring now to FIGS. 7 and 9, the cabinet 10 includes side members 206, preferably in the form of mirrors, which are generally identical to the side members 92 and 94 discussed in conjunction with FIGS. 1–4 above. The main difference between the side members 206 and the side members 92 and 94 is that side members 206 are longer than the cabinet 10 and extend up to the height of the top wall 138 of the light fixture 130. This allows the combination cabinet 10 and light fixture 130 to have its sides completely masked to hide any hardware and the side walls 16 and 18.

To assemble the bath cabinet 10 and light fixture 130 in accordance with the third preferred embodiment, the bath cabinet 10 is surface mounted to the mounting wall 12, as described above. A pair of clamping members 188 are then secured to the frame member 132 of the light fixture 130, utilizing the fastener elements 190. The first leg 194 and second leg 196 are positioned with respect to each other so as to be able to receive the flange 186 therebetween. The light fixture 130 is then positioned on the cabinet 10 with the bottom wall 140 in abutting engagement with the upper member 54 of the cabinet frame 52. Additionally, the flange 186 is located between the first and second legs 194 and 196. A screwdriver or the like is then used to rotate the threaded member 204 to move the first leg 194 with respect to the second leg 196 to firmly grip the flange 186 and secure the light fixture 130 to the cabinet 10. The light fixture 130 is then assembled and the side members 206 are secured to the cabinet 10, as described above.

From the foregoing description, it can be seen that the present invention comprises a light fixture and bath cabinet which can be recessed or surface mounted without exposing the hardware thereof so that the light fixture and cabinet are aesthetically pleasing. It is recognized by those skilled in the art, that changes may be made to the above-described embodiments of the invention without departing from the broad inventive concepts thereof. It is understood, therefore, that this invention is not limited to the particular embodiments disclosed, but is intended to cover any modifications which are within the scope and spirit of the invention as defined by the appended claims.

I claim:

1. A light fixture for mounting on a surface of a mounting wall proximate a cabinet, said light fixture comprising:

a frame member having a back wall for being secured to a mounting wall such that said back wall and mounting wall are in facing engaging relationship, a top and bottom wall extending outwardly from said back wall at opposite ends thereof, said top wall including a flange-like member at a distal end thereof, said bottom wall including a flange-like member at a distal end thereof, said top wall flange-like member and said bottom wall flange-like member extend toward each other;

a front wall having electrical elements mounted therein for receiving light means for illuminating an area surrounding the front wall, said front wall including a first and second channel-like member positioned thereon, said front wall being releasably secured to said top and bottom walls such that said top wall flange-like member is positioned within said first channel-like member and said bottom wall flange-like member is positioned within said second channel-like member; and first and second side covers each having at least one protrusion extending outwardly therefrom, said first side cover being releasably positioned on one end of said frame member with said protrusion being frictionally secured to said top or bottom wall and said second side cover being releasably positioned on the other end of said frame member with said protrusion being frictionally secured to said top or bottom wall whereby when said light fixture is assembled, said flange-like members, said channel-like members and said protrusions are not exposed to view.

2. The light fixture as recited in claim 1, wherein said first and second side covers are comprised of an extruded member having a mirrored panel secured thereto.

3. The light fixture as recited in claim 1, wherein said front wall is comprised of an extruded member having a mirrored panel secured thereto.

4. The light fixture as recited in claim 1, wherein said frame member is a single extruded member.

5. The light fixture as recited in claim 1, wherein said first channel-like member is larger than said second channel-like member for allowing said front wall to be interlocked to said top and bottom walls.

6. The light fixture as recited in claim 1, wherein said first and second side covers each include two protrusions extending outwardly therefrom, one being frictionally secured to said top wall and the other being frictionally secured to said bottom wall.

7. The light fixture as recited in claim 6, wherein said frame member further includes an inwardly extending top rib-like member and an inwardly extending bottom rib-like member positioned proximate said top and bottom walls, respectively, one of said protrusions of each side cover being frictionally positioned between said top wall and said top wall flange-like member and top rib-like member and between said bottom wall and said bottom wall flange-like member and bottom rib-like member.

8. The light fixture as recited in claim 1, wherein said top and bottom walls extend generally perpendicularly from said back wall, said front wall being sized to completely extend between said top and bottom wall and said top, bottom, front and back walls each being of the same general horizontal length.

9. The light fixture as recited in claim 1, wherein said frame member further includes a second aperture therein for receiving electrical wires therethrough for electrical communication with said electrical elements.

* * * * *